United States Patent [19]

Friedman et al.

[11] 4,023,230

[45] May 17, 1977

[54] RETRACTABLE BRISTLE BRUSH

[75] Inventors: Jack S. Friedman, Highland Park; William J. Kenney, Villa Park, both of Ill.

[73] Assignee: Jack S. Friedman, Highland Park, Ill.

[22] Filed: Sept. 4, 1975

[21] Appl. No.: 610,450

[52] U.S. Cl. ..... 15/185; 15/169; 132/119; 132/121

[51] Int. Cl.[2] ..... A46B 9/10

[58] Field of Search ..... 15/184, 185, 169; 132/119, 120, 121, 123, 143

[56] References Cited

UNITED STATES PATENTS

| | | | |
|---|---|---|---|
| 1,189,698 | 7/1916 | Keating | 15/184 |
| 2,431,865 | 12/1947 | Dempsey | 132/119 X |
| 2,604,649 | 7/1952 | Stephenson et al. | 15/185 |

*Primary Examiner*—Peter Feldman
*Attorney, Agent, or Firm*—McDougall, Hersh & Scott

[57] ABSTRACT

A retractable bristle brush comprising a housing having a bottom side, a top side, spaced side walls and spaced end walls, a plurality of openings extending inwardly from the bottom side, a plurality of bristles aligned with said openings, means mounted for movement between retracted and extended positions of adjustment relative to the housing, the inner ends of said bristles being connected to said means for movement of said bristles through said openings to retracted position within the housing responsive to movement of said means to retracted position and for movement to extend perpendicularly outwardly from the bottom side of the housing responsive to movement of said means to extended position.

2 Claims, 19 Drawing Figures

12
12a
H

RETRACTABLE BRISTLE BRUSH

This invention relates to bristle brushes of general utility and particularly to a brush which can be carried in the pocket, purse or baggage, such as a clothes brush, hair brush, shoe brush.

It is desirable to make available a small bristle brush which occupies little space, which does not expose the brush bristles to snag fabrics and the like materials which come into contact with the brush during storage, and in which the bristles are not exposed during periods of non-use so as to enable the brush to be carried in a pocket, purse, baggage, or for use as a traveling brush.

Small bristle brushes for carrying in a pocket, purse or baggage are well known wherein the brush bristles are fixed to extend from the face of the backing member which is normally provided with a handle extending therefrom. However, such brushes find widespread objection from the standpoint of hair becoming entwined with the bristles which require removal by combing or the like; the space occupied by the brush; the fact that the bristles, which are fixed to extend from the back, take on a permanent deformation due to lack of protection against distortion during storage, whereby the brush becomes unsuitable for subsequent use, and because fabrics and other elements are exposed to the stiff bristles which can cause damage to fabrics and the like materials associated therewith.

It is an object of this invention to produce a brush in which a handle is joined to form an extension from a backing with means for movement of the bristles to extend perpendicularly from the backing when in position of use and to be confined wholly within the backing when in position of non-use whereby the brush is characterized by (1) taking up minimum space when in position of non-use, (2) protection of the bristles when in position of non-use, (3) protection of associated elements from the brush bristles when in position of non-use, (4) cleaning of the bristles responsive to relative movement between the bristles and housing between position of use and non-use, respectively; (5) ease of actuation between positions of use and non-use; and (6) support of the bristles in the desired alignment during extension from the brush in position of use, and it is a related object to provide a small hand bristle brush of the type described which can be easily assembled from readily available materials to produce a low cost brush which can be easily adjusted between positions of use and non-use.

These and other objects and advantages of this invention will hereinafter appear and for purposes of illustration, but not of limitation, an embodiment of the invention is shown in the accompanying drawings, in which.

Figures 11, 11A, 12, 12A, 13:
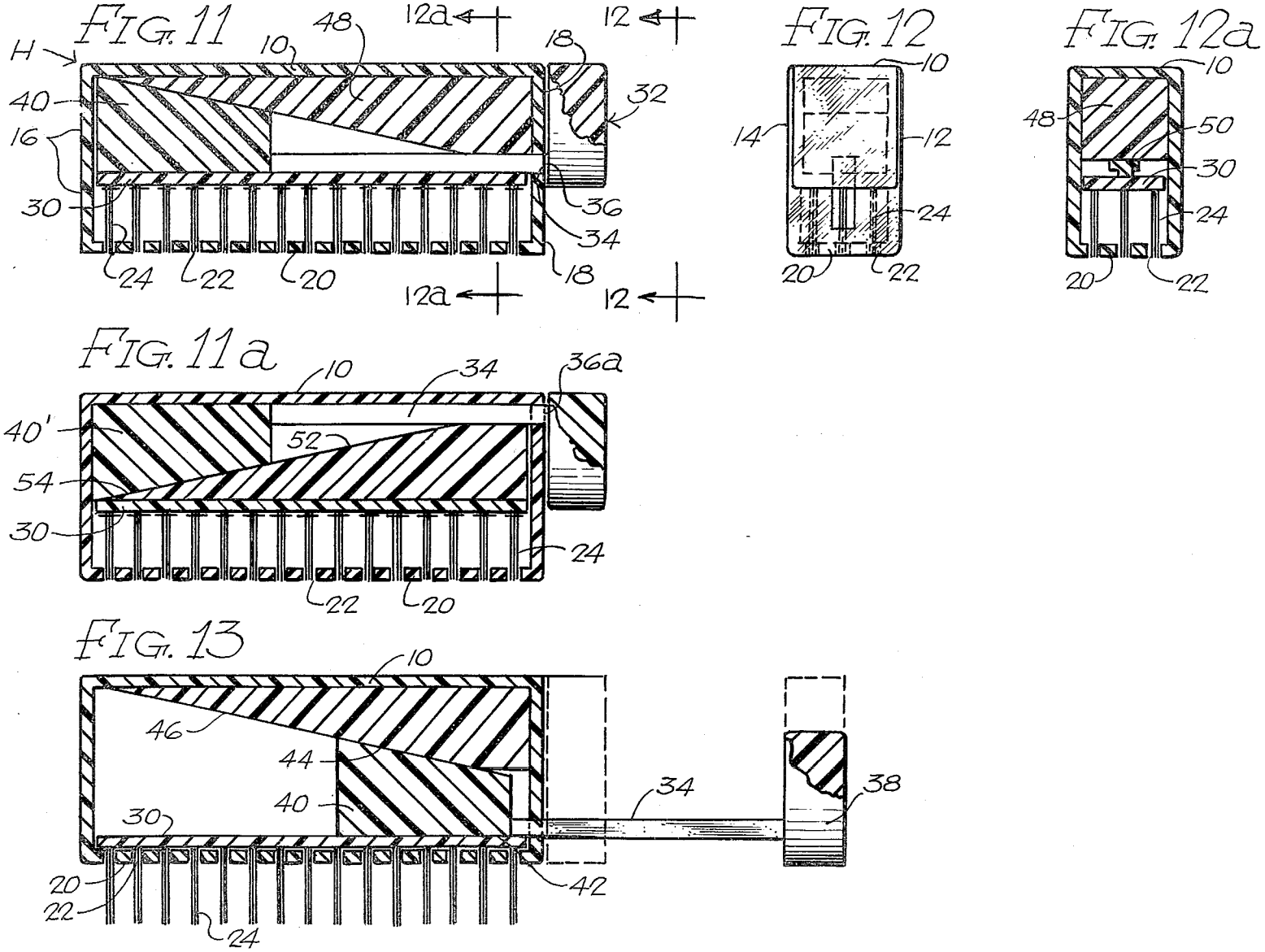
FIG. 11 is a sectional view of a modification in a bristle brush embodying the features of this invention, in position of non-use or closed position.
FIG. 12 is an end elevational view of the brush shown in FIG. 11.

FIG. 11*a* is a sectional elevational view similar to that of FIG. 11 showing a modification in the actuating means;

FIG. 12*a* is a sectional view of the brush shown in FIG. 11*a;*

Figure 15:
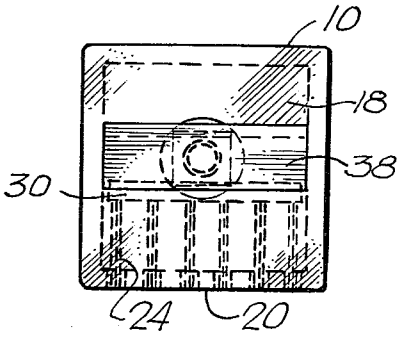
Figure 17:
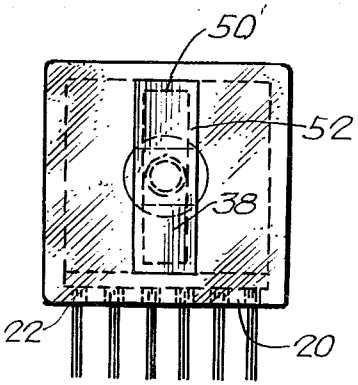
Figure 14:
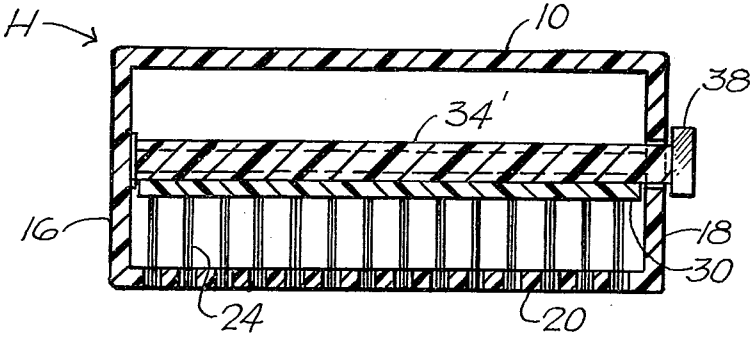
Figure 16:
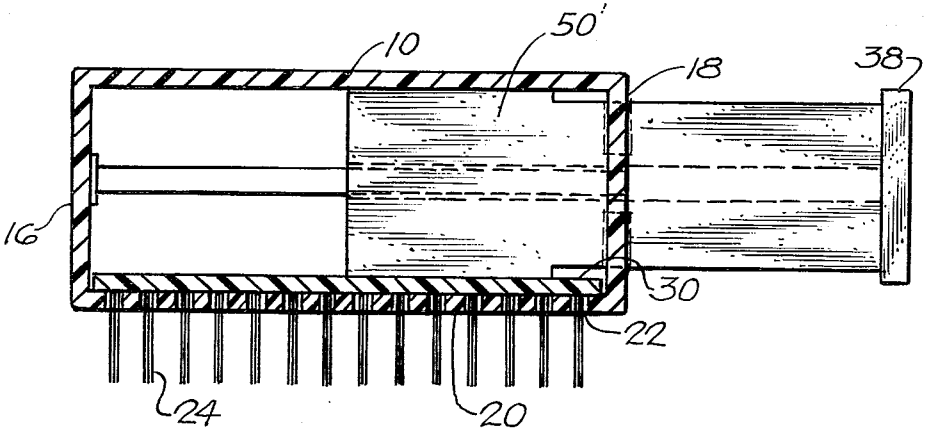

FIG. 13 is a sectional view of the brush shown in FIG. 11 in the position of use or extended position;

FIG. 14 is a sectional elevational view similar to that of FIG. 11 showing a further modification of a brush embodying the features of this invention, in closed position;

FIG. 15 is an end elevational view of the brush shown in FIG. 14;

FIG. 16 is an elevational view of the brush shown in FIG. 14 in open position; and FIG. 17 is an end elevational view of the brush shown in FIG. 16.

The desired objectives are achieved, in accordance with the practice of this invention, by a brush constructed of a housing H of rectangular shape having a top wall 10, side walls 12 and 14, end walls 16 and 18, and a bottom wall 20. The bottom wall 20 is provided with a plurality of openings 22 extending therethrough to the interior of the housing and the bristles 24, in the form of bundles, are aligned for movement outwardly through the openings 22 to project substantially perpendicularly from the bottom wall 20, when in extended position of use, and rearwardly through the openings 22 into the interior of the housing H, when in retracted position of non-use.

In the modification illustrated in FIGS. 11–13, the bundles of bristles 24 are anchored at their inner end to a support plate 30 which is dimensioned to span the interior of the housing H and is mounted therein for movement in the direction toward and away from the bottom wall 20, between extended and retracted positions within the housing, with the bundles of bristles 24 in endwise alignment with the openings 22, and with the ends of the bristles engaged within the openings 22, when in retracted position.

Means are provided for displacement of the support plate 30 between extended and retracted positions within the housing. In the modification illustrated in FIGS. 11–13, such means comprises a pair of interengaging cam surfaces which operate to effect displacement of the support plate 30 between extended and retracted positions, responsive to linear movement of a handle 32 relative to the end wall 18 of the housing between extended and retracted positions. The linear movement of the handle 32 is translated to movement of the support plate 30, in a direction perpendicularly therethrough, responsive to interengagement of the cam surfaces.

For this purpose, the handle 32 is formed with a handle rod 34 which extends through a vertical slot 36 in the end wall 18 of the housing H with the throughextending handle portion being dimensioned to correspond to the cross section of the handle rod 34 to enable the rod slidably to extend therethrough, with a knob 38 of larger cross section on the end of the rod outwardly of the housing and with a slide block 40 of trapezoidal shape on the through-extending end portion of the rod in the interior of the housing. The slide block 40 has a bottom wall 42 which defines a plane parallel with the top side of the support plate 30, slidably to rest on the support plate, while the top wall 44 of the slide block is inclined downwardly from the outer end to provide an inclined plane which slidably engages an inclined plane 46 of corresponding slope on the bottom side of the top wall 10, as provided by an insert 48 fixed to the bottom side of the top wall 10.

In practice, the knob portion 38 is dimensioned to correspond with the cross section of the end wall 18 with the rod 34 dimensioned to locate the knob alongside the end wall, when in retracted position, so that the knob 38 will appear as a mere extension to form a part of the housing and thereby conceal the opening 36 through the end wall. The slide block is dimensioned to have a cross section greater than that of the opening thereby to function as a stop for the handle upon engagement of the slide block with the wall 18, when in the extended position.

Thus in the retracted position, the knob 38 will lie alongside the housing with the bristles concealed within the housing so that all of the elements are protected in a compact concealed package of small dimension. When it is desired to make use of the brush, it is only necessary to pull out the handle A from its retracted position to its extended position. The slide block 40 is displaced in the endwise direction with the handle and, in response to the engagement between the inclined plane, the slide block and handle are cammed downwardly with corresponding displacement of the support plate 30 from retracted to extended position to project the bundles of bristles 24 through the openings into position of use.

While in this position, shown in FIG. 13, the brush is characterized by the conventional elements, including a handle portion A joined to a housing H with the brush bristles extending outwardly from the bottom wall of the housing and with the bristles of the brush spread from the openings to correspond with the desirable bristle arrangement in a conventional utility brush.

When it is desired to return the brush to closed, concealed position, it is only necessary to push the handle A back into the housing. In response to such movement, the cam surfaces enable the support plate 30 to return to retracted position, with concurrent retraction of the bristles into the interior of the housing, and concealment of all of the elements, as shown in FIG. 11.

Use may be made of leaf spring members located between the support plate 30 and the bottom wall 20 constantly to urge the support plate for return to retracted position, as permitted by the slide block. Instead, the slide block may be keyed into the support plate, as by means of a key, illustrated in FIG. 12*a* as a T-shaped projection 48 extending from the surface of one of the aforesaid members for sliding engagement within a T slot 50 extending lengthwise in the other of said members.

Similarly, the inclined cam surfaces can be urged into constant engagement by resilient spring means or they can be positively interengaged by a similar key and slot arrangement, such as a T-shaped key extending from one in sliding engagement within a T-shaped slot in the other.

Instead of providing the camming action in response to sliding engagement between an inclined plane in the top surface of the slide block and the bottom side of the top wall, the operative engagement may be provided between an inclined plane 52 in an insert fixed to the top side of the support plate 30, and the bottom side of the slide block 54 with the top surface of the slide block parallel with the bottom side of the top wall 10, for sliding engagement therewith, without inclination, as illustrated in FIG. 11*a*. Under this arrangement, the support plate 30 will be displaced in a direction perpendicular to the direction of movement of the slide plate with corresponding movement of the slide plate and handle in the same direction, so that it would be sufficient merely to provide an opening 36*a* through the end wall 18 corresponding to the cross section of the handle rod 34, thereby to provide greater support between the handle and the housing.

By way of still further modification, it will be apparent that the inclined surfaces can be provided in both the top side and bottom side of the slide block 40 for engagement with parallel inclined surfaces in both the bottom side of the top wall and the top side of the support plate.

In the modification shown in FIGS. 14–16, the means for actuation of the support plate 30 between retracted and extended positions, comprises a block 50 located within the housing H in the space between the bottom side of the top wall 10 and the top side of the support plate 30 with the block having a cross section which is rectangular or oblong in shape with a greater dimension in one cross section than in the cross section perpendicular thereto but with the major dimension still being less than the width between the side walls of the housing to enable the block to be rotated about its axis through an angle of 90°. The block 50′ is operatively connected to the handle rod 34′ as a part thereof or preferably via an elongate bore 52 of rectangular or polygonal shape dimensioned slidably to receive the handle rod portion 34′ of corresponding cross section therein to enable relative endwise displacement of the handle between extended position shown in FIG. 16 and retracted position shown in FIG. 14 while effecting turning movement of the block 51 responsive to turning movement of the handle 34′.

Thus, when the handle is in retracted position and turned to position the block 50′ with its major dimension extending crosswise between the side walls of the housing, the support plate 30 will be in retracted position and the handle will be in retracted position, all as shown in FIG. 14.

When it is desired to use the brush, the handle 34′ is pulled out and then turned to an angle of 90°. In response to the corresponding turning movement of the block 50′, whereby its major dimension will extend between the top side of the support plate 30 and the bottom side of the top wall 10, the support plate will be actuated from its retracted position to extended position to project the bundle of bristles 24 to extend through the openings 22 in the bottom wall 20, in brush-like fashion.

Resilient means, such as leaf springs (not shown) between the top side of the bottom wall 20 and the bottom side of the support plate 30 operate resiliently to urge the support plate 30 to retracted position, as permitted by rotation of the block 50′ to retracted position with the major dimension again extending crosswise between the side walls of the housing while the minor dimension extends between the top wall and the support plate.

Figure 1:
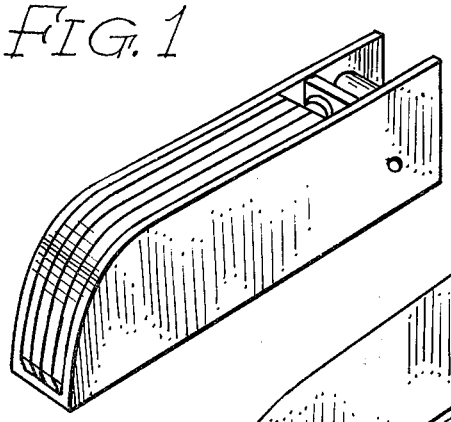
FIG. 1 is a perspective view of a modification of a bristle brush embodying the features of this invention, in closed position.
Figure 2:
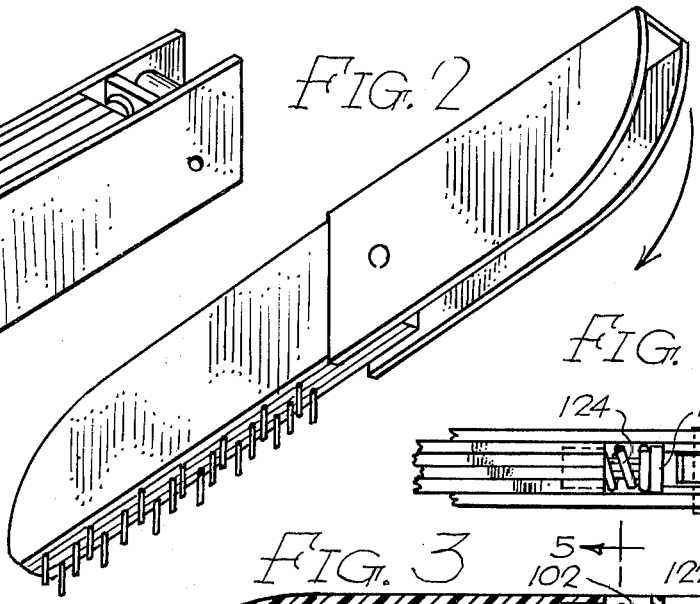
FIG. 2 is a perspective view of the brush shown in FIG. 1, in open position.
Figure 4:
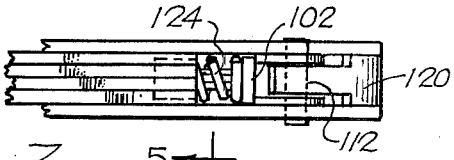
FIG. 4 is a top view of the brush shown in FIG. 1.
Figure 5:
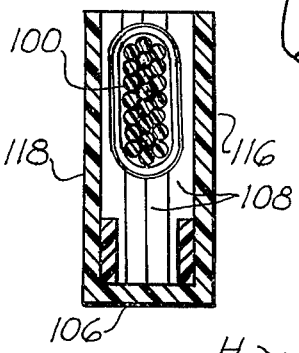
FIG. 5 is a sectional view taken along the line 5—5 of FIG. 3.
Figure 3:
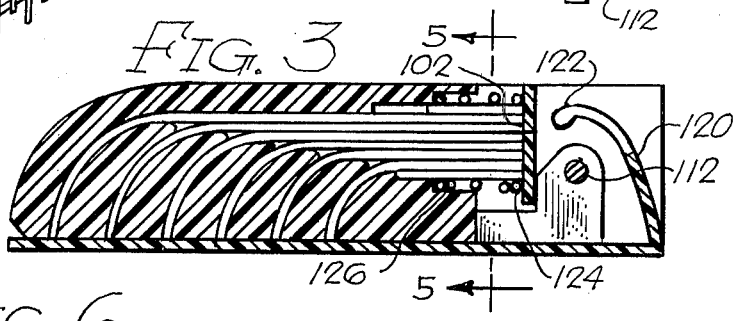
FIG. 3 is a sectional elevational view taken lengthwise of the brush shown in FIG. 1.
Figure 6:
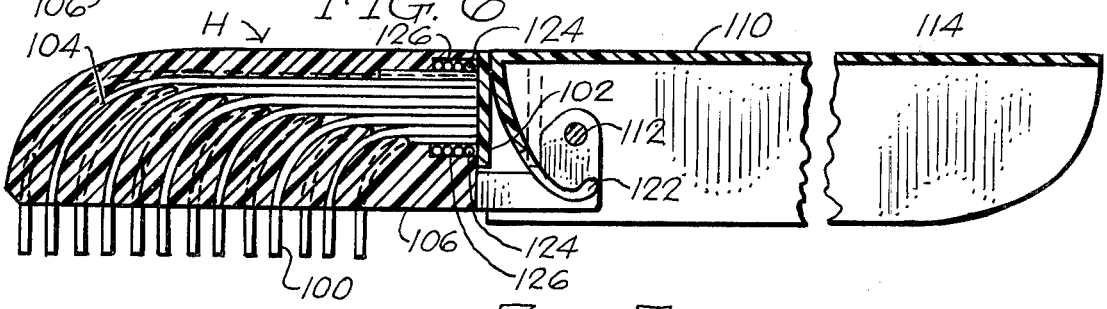
FIG. 6 is a sectional view taken lengthwise along the brush shown in FIG. 2.
Figure 7:
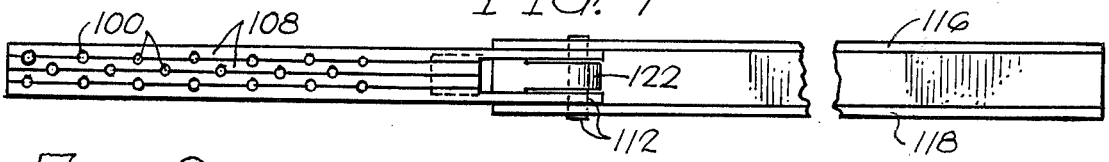
FIG. 7 is a top plan view of the brush shown in FIG. 6.

In the modifications illustrated by FIGS. 1–10, the bundles of bristles 100 are anchored at their inner ends to a vertically disposed slide plate 102 mounted for displacement in the lengthwise direction relative to the housing H with the free ends of the bundles of bristles extending through a series of longitudinally spaced and crosswise spaced guide slots 104 which extend curvilinearly through the interior of the housing and terminate in an end portion which extends perpendicular to the plane formed by bottom side 106 of the housing. The bundles of bristles 100 are of different lengths, corresponding to the distance between the slide plate 102 and the end of the slot 104 in which the particular bundles are located so that the ends of the bundles will be located at the ends of the slot when the slide plate is in retracted position, as shown in FIG. 3, and projected to extend perpendicularly from the bottom side of the housing in response to movement of the slide plate 102 forwardly to extended position, as shown in FIG. 6.

The curvilinear guide slots 104 are provided by a plurality of plates 108 arranged in side by side relation within the housing with curvilinear grooves in the adjacent surfaces of the plates 108 which cooperate to form the curvilinear slot therebetween. In the modification shown in FIGS. 1–7, the slide plate 102 is actuated from retracted position to extended position in response to rocking movement of the handle portion 110 about its pivot 112 from closed to open position.

The handle portion 110 is formed of a top wall 114 which is dimensioned to have a length corresponding to the length of the housing and side walls 116 and 118 which extend downwardly from the lateral edges of the top wall and are spaced one from the other by an amount slightly greater than the distance between the side walls of the housing, with the side walls formed with curvilinear ends to correspond with the vertical profile of the housing.

In closed position, the housing is disposed substantially completely within the handle portion 110 with the side walls 116 and 118 positioned immediately outwardly of the side walls of the housing and with the top wall underlying the bottom side of the housing to cover the openings with the bundles of bristles in retracted position within the openings.

The means for actuation of the slide plate from retracted position to extended position, in response to rocking movement of the handle portion from closed to open position, is shown in FIGS. 1–7 as comprising a tongue 120 which extends curvilinearly inwardly from the inner end portion of the top wall 114 of the handle 110, beyond the pivot 112, with the tongue formed with a slotted portion 122 to clear the pivot. As the handle is rocked from closed to open position, the curvilinear end portion of the tongue 120 engages the back side of the slide plate 102 to push the plate forwardly from retracted to extended position. Thus the bundles of bristles are projected to extend perpendicularly from the bottom side of the housing as the handle is rocked to open position, as illustrated in FIG. 6.

The elements are returned to retracted position in response to return of the handle portion 110 to closed position to enclose the housing. For this purpose, use is made of a resilient means such as a coil spring or leaf spring 124 mounted in an annular groove 126 between the front face of the slide plate 102 and an abutment in the rear end portion of the housing H constantly to urge the slide plate to retracted position in response to release by the tongue, during rocking movement of the handle portion to closed position.

Figure 8:
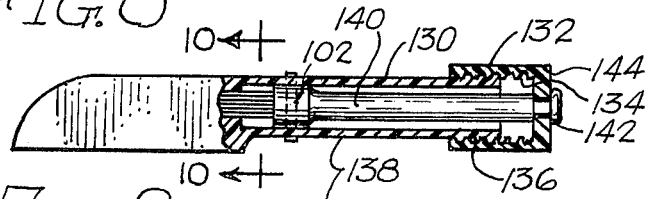
FIG. 8 is a sectional elevational view partially in section showing a modification in the actuation of the brush between open and closed positions.
Figure 9:
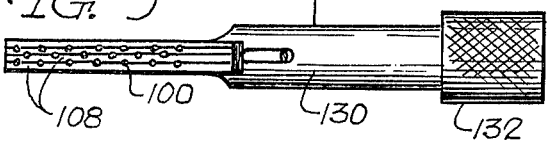
FIG. 9 is a top plan view of a brush as shown in FIG. 8.
Figure 10:
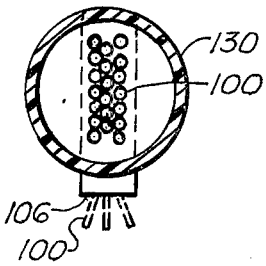
FIG. 10 is a sectional view taken along the line 10—10 of FIG. 8.

Instead of tongue and spring actuation of the slide plate between retracted and extended positions, such actuation can be effected by turning movement of a portion of the handle, as illustrated in FIGS. 8–10.

As illustrated, the handle portion 130 is formed with a telescoping end section 132 having internal threads 134 which threadably engage a threaded portion 136 on the telescoped outer end portion of the handle 130. Thus in response to turning movement of the telescoping section 132, relative to the telescoped section 138, the telescoping section is displaced endwise relative to the telescoped section. An elongate rod 140, fixed at its inner end to the back side of the slide plate 102, extends through the hollow handle portion and through a central opening in the end wall 144 with a reduced portion 142 in the throughextending portion to enable free rotational movement of the telescoped portion 132 relative to the rod while providing for conjoint endwise movement. Thus by turning the handle end portion 132 in one direction, the slide plate is displaced inwardly to extended position and by turning movement of the handle portion in the opposite direction, the slide plate is withdrawn to retracted position.

We claim:

1. A retractable bristle brush comprising a housing having a bottom side, a top side, spaced side walls and spaced end walls, a plurality of openings extending inwardly from the bottom side, a plurality of bristles aligned with said openings, means mounted for movement between retracted and extended positions of adjustment relative to the housing, the inner ends of said bristles being connected to said means for movement of said bristles through said openings to retracted position within the housing responsive to movement of said means to retracted position and for movement to extend substantially perpendicularly outwardly from the bottom side of the housing responsive to movement of said means to extended position in which the interior of the housing is formed with a plurality of laterally and longitudinally spaced apart channels which terminate as openings through the bottom side of the housing to extend substantially perpendicularly thereof, said channels extending curvilinearly through said housing and to terminate at their inner ends facing in a direction perpendicular to their outer end, in which the means mounted for movement between retracted and extended positions of adjustment relative to the housing comprises a support plate mounted within the housing for relative lengthwise movement in a direction toward and away from the inner ends of the channels, said bristles being slidably received within said channels and connected at their inner ends to the support plate, and means for actuation of said support plate between extended position for projection of the bristles outwardly from said opening beyond the bottom side of the housing, and retracted position for withdrawal of the bristles to bring their inner ends within the housing.

2. A retractable bristle brush as claimed in claim 1 which includes a handle dimensioned to enclose said housing when in closed position and to expose said housing when in open position, means pivotally mounting the handle on the housing and means forming a part of the handle in position operatively to engage said support plate whereby the support plate is displaced between extended and retracted positions responsive to opening and closing movement of the handle, respectively.

* * * * *